US012233300B1

(12) United States Patent
Benham et al.

(10) Patent No.: US 12,233,300 B1
(45) Date of Patent: Feb. 25, 2025

(54) YOGA BLOCK SYSTEM

(71) Applicants: Merri Kay Benham, Yalaha, FL (US); Daniel Goodrich, Yalaha, FL (US)

(72) Inventors: Merri Kay Benham, Yalaha, FL (US); Daniel Goodrich, Yalaha, FL (US)

( * ) Notice: Subject to any disclaimer, the term of this patent is extended or adjusted under 35 U.S.C. 154(b) by 99 days.

(21) Appl. No.: 18/107,198

(22) Filed: Feb. 8, 2023

Related U.S. Application Data

(60) Provisional application No. 63/430,806, filed on Dec. 7, 2022.

(51) Int. Cl.
*A63B 21/00* (2006.01)
*A63B 21/002* (2006.01)

(52) U.S. Cl.
CPC ..... *A63B 21/00047* (2013.01); *A63B 21/002* (2013.01); *A63B 2209/08* (2013.01)

(58) Field of Classification Search
CPC ..... A63B 21/00047; A63B 21/002; A63B 21/4037; A63B 21/4039; A63B 2209/08; A63B 2023/006
See application file for complete search history.

(56) References Cited

U.S. PATENT DOCUMENTS

| | | | | |
|---|---|---|---|---|
| 7,824,319 | B2 * | 11/2010 | Carlesimo | A63B 21/00047 482/141 |
| 2007/0219076 | A1 * | 9/2007 | Axelrod | A63B 21/00047 482/148 |
| 2013/0274078 | A1 * | 10/2013 | Andrews | A63B 23/1236 482/141 |
| 2018/0304114 | A1 * | 10/2018 | Feinstein | A63B 21/4037 |
| 2019/0366144 | A1 * | 12/2019 | Thiede | A63B 21/4037 |
| 2023/0211203 | A1 * | 7/2023 | Marable, Jr. | A63B 21/4039 482/142 |
| 2024/0082626 | A1 * | 3/2024 | Kocott | A63B 23/0458 |

* cited by examiner

*Primary Examiner* — Megan Anderson
(74) *Attorney, Agent, or Firm* — Gulf Coast Intellectual Property Group

(57) ABSTRACT

A yoga block system that is comprised of a plurality of props wherein the props are configured to be releasably secured in order to facilitate creation of a multitude of configured props having various shapes and sizes. The prop of the present invention is provided in various shapes and sizes. At least one surface of the prop includes a magnet secured therein. The magnet can be secured so as to be in one of three positions; flush, recessed or extended. The magnets of the props are aligned in a pattern so as to facilitate releasable securing of a first prop to a second prop. The prop can further be configured with a peg extending outward from a surface thereof wherein the peg is operable to be inserted into a hole formed in a surface of a prop that is designed to be releasably secured thereto.

8 Claims, 5 Drawing Sheets

YOGA BLOCK SYSTEM

PRIORITY UNDER 35 U.S.C Section 119(e) & 37 C.F.R. Section 1.78

This nonprovisional application claims priority based upon the following prior United States Provisional Patent Application entitled: Interlocking Yoga and Fitness Prop System, Application No.: 63/430,806 filed Dec. 7, 2022, in the name of Merri Benham, which is hereby incorporated by reference for all purposes.

FIELD OF THE INVENTION

The present invention relates generally to a set of props for yoga or other activities. A set of props may include eleven connectable props of six different types. The props may be used individually, or in whatever configuration of props suits a user's purpose. The props are lightweight and non-compressible. The props are sealed against absorbing moisture so they may be easily cleaned. A prop may be releasably connected to one or more other props for different configurations of props. The props may be connected by a pair of magnets and/or pegs.

BACKGROUND

Yoga is essentially a spiritual discipline based on an extremely subtle science, which focuses on bringing harmony between mind and body. It is an art and science of healthy living. The word yoga is derived from the Sanskrit root Yuj, meaning to join or. Yogic scriptures the practice of yoga leads to the union of individual consciousness with that of the universal consciousness, indicating a perfect harmony between the mind and body, man and nature. According to modern scientists, everything in the universe is a manifestation of the same quantum firmament. One who experiences this oneness of existence is said to be in yoga having attained to a state of freedom referred to as nirvana. The aim of yoga is self-realization, to overcome all kinds of sufferings. Yoga also refers to an inner science comprising of a variety of methods through which human beings can realize this union and achieve mastery. Yoga is practiced with the assistance of trained professionals or individually. Various equipment such as but not limited to blocks and mats are employed when engaged in the practice of yoga.

SUMMARY OF THE INVENTION

One or more props from the set of props according to the invention may be used by a person in the practice of yoga for one or more reasons. For example, one or more props may be used to support a person while in a yoga pose. As another example, one or more props may be used by a person to facilitate a yoga pose such as deepening the yoga pose. In yet another example, one or more props may be used by a person to achieve proper form in a pose. For another example, one or more props may be used to assist in correcting a person's personal geometry such as in the case, for example, when a person has one leg longer than the other. In addition, one or more props may be used to relieve muscle tension in a person and relax the nervous system by forming one's personal structure in restorative poses. Further, one or more props may be used as a teaching tool to create challenges for the progression of one's personal practice. For example, one or more of the props from a kit may be used respectively as a balance board, a back bed mount, or in hand balancing configurations.

Advantageously, the present invention may be used by a person in their own practice of yoga. A yoga studio offering yoga classes may provide the present invention to its patrons. The present invention may be made available in a physical therapy setting, a gym, a workout location, and sports facility practices. Institutions such as schools, colleges, churches, hospitals, rehabilitation centers, and day care centers may stock a kit of props for use by students, members, patients, customers, and clients. Another advantage of the present invention is its utility to persons whatever the settings. The present invention may be used by beginners of a practice as well as those with more experience including advanced practitioners. The present invention is appropriate for use by children, adults, seniors, and pregnant women. With appropriate assistance, a kit of blocks may be used by patients receiving physical therapy as well as the infirm, the challenged.

The present invention provides eleven props of six different sizes and shapes, which are described in detail below. However, the types of elements should not be limited to the exemplary elements presented herein, and other embodiments may include more, different, or fewer elements than the exemplary kit of props described herein. Each of the props is made of wood framing covered in a thin layer of plywood, which is referred to herein as a wood frame ply combo. In other embodiments, the props may vary in composition. An advantage of the props being made of a wood frame ply combo is that such a prop is lighter than a comparable prop made of cork or solid wood. The use of a wood frame ply combo in the props makes them comparable to foam props in weight but provides for the same approximate rigidity of cork or wood. Also, an advantage is that the use of a wood frame ply combo provides a lightweight reinforced design that does not compress like some foam props. Some foam props compress when in use. The compression of foam props may lead to loss of balance or one or more of the foam props popping out from under a user.

Another advantageous feature of the props in the present invention is that each of the props is sealed to be waterproof. The props are sealed with a waterproof sealer such as a liquid rubber non-toxic colored waterproof sealer. Unlike foam and cork props, the sealed props of the exemplary kit of props prevent moisture intrusion. The sealed props do not absorb sweat or other moisture. Another advantage is that the sealed props are easily disinfected. The sealed props do not absorb the disinfectant. In addition, another advantage of the present invention is that one or more props may be provided a non-slip feature on one or more sides of the prop. The non-slip feature aids in keeping a prop from sliding on the mat or floor, or keeping a user's hand or other body part from slipping off the prop. The non-slip feature may be provided in any appropriate manner. Other embodiments may vary.

Among the reasons the present invention provides the above advantages is that a prop may be used on its own or may be combined with one or more other props from the kit. In other words, an individual prop may be combined with another or more props to construct a different type of prop that may be referred to herein as a, configured prop. Many types of configured props may be constructed from the variety of individual props in a kit. Also, the same three props, for example, may be combined in more than one way so that there may be multiple varieties of configured props from the same three props. The combination feature of the props provides the advantage of customizability. A user may combine props to achieve a preferred height, width, depth, and shape of a configured prop. Props may be combined according to a user's preference in flexibility, strength, and weight. The physical limitations of a particular user may be addressed by a configured prop combined from props suited uniquely to the user. The present invention may provide a variety of props for a variety of purposes. The props in a set may vary.

A further advantage of the present invention is that configured props are connected in a manner that allows for creation of a multitude of functional secure configurations. Details of the manners of connection between props are provided in detail below but may be referred to as a magnetic pair system. It provides for one or more holes in a prop of varying depth with each hole receiving a magnet affixed inside. A deep hole is configured so that the magnet affixed inside sits below the surface of the prop, making a female connection. A shallow hole is configured that the magnet affixed inside sits above the surface of the prop, making a male connection. The polarity of the exposed face of the magnet correlates to the depth of the hole, such that a deep hole has a polarity of north or south and a shallow hole is configured to the opposite polarity so that they will attract. Props may be connected by pairing a male connection on one prop with the female connection of another. An additional prop or props may be added to the two connected props in the same magnetic pair system manner to result in a configured prop of three or more connected prop.

In an exemplary embodiment, the magnetic pair system may utilize neodymium or ferrous magnets. For example, a magnet of ¾ inch diameter and ⅛th to ½ inch thickness may be used. It is preferred that the holes in a prop and the holes in all of the props are of the same size and shape to allow for the proper mating of male and female connections. Other embodiments may vary, and the magnets could alternatively be square, rectangular, or any other shape. In this embodiment, the connection between props may be due at least in part to the magnetic attraction between the male and female connections. An advantage of using a magnetic pair system in a kit of props is that the magnetic connections between male and female connections may be easily made at the time of connection and easily broken when it is time to dissemble a configured prop. A further advantage of the magnetic pair system is that the mating connections are readily attracted to one another for quick and easy pairing. Also, the magnetic pair system may make for the transport of configured props easier in that the props stick together more readily when moved. Finally, the magnetic pair system provides users with a satisfying grab that indicates connection.

In another embodiment, the use of male and female connections within the magnetic pair system prevents the props from separating due to shearing forces. For example, a magnetic pair could be configured such that the distance between the face of a prop and exposed face of the magnet of the male connection is $1/32^{nd}$ inch, and that the distance between the face of prop and the exposed face of the magnet of the female connection is greater than or equal to that of the male connection. This ensures that the faces of two connected props can sit flush with one another. Ideally, the magnets are equal in size to the hole they are affixed to, and both male and female connections are the same size. In this embodiment, the magnetic bond between male and female connections is less prone to shearing apart as the male connection is secured within the face of the prop of the female connection. The union between two props can be further reinforced by an additional peg system. It provides for one or more holes in a prop with each hole receiving half of a peg. The other half of the peg is inserted into a hole in another prop to connect the two props. An additional prop or props may be added to the two connected props in the same peg system manner to result in a configured prop of three or more connected prop.

In an exemplary embodiment, the additional peg system may provide a wooden dowel as a peg. Preferably, all the pegs used in the peg system are of the same size and shape so the pegs are interchangeable. Also, it is preferred that the holes in a prop and the holes in all of the props are of the same size and shape to receive any of the pegs of the peg system. Other embodiments may vary with a preferred embodiment of utilization of two pegs but embodiments could employ more or less than two pegs. For example, the present invention may have props having varying sizes of holes to receive respective various sizes of pegs. In this embodiment, the pegs are not interchangeable. Specifically, a prop may include one or more holes that are wider in diameter than other holes in the prop. The wider holes may receive pegs that are wider in diameter in this other embodiment. In another embodiment, the additional peg system may include a magnetic feature(s) and may be referred to herein as a magnetic peg system. In this system, each hole in a prop may be outfitted with at least a magnet. For example, a magnet of ⅜th inch diameter and 1/16 to ⅛th inch thickness may be used. The pegs of the magnetic peg system may be made at least in part of metal or be at least partially magnetic. For example, the pegs may be ⅜th inch in diameter and ¾ inch length. In this other embodiment, the connection between props may be due at least in part to the magnetic attraction between the magnetic holes and respective metal or magnetic pegs as well as that of the pegs being fit into their respective holes. An advantage of using a magnetic peg system is that the magnetic connections between hole and pegs may be easily made at time of connection and readily broken when it is time to dissemble a configured prop. Also, the magnetic peg system may make for transport of configured props easier in that the props stick together more readily when moved than the peg and hole system. In addition, the magnetic peg system avoids at least in part some of the problems of the peg and hole system with respect to expansion, and contraction. Finally, the magnetic peg system may reduce wear and tear on the connecting elements.

Another advantage of the magnetic pair system in the inventive kit of props is with respect to the storage of the kit. The props of a kit may be connected by the magnetic pair system to create a stacked kit that keeps all the props together. The stacked kit may be compact and easy to store as a unit. Because of the connections between props, the stacked kit is stable as a unit rather than being loose, individual props. The stacked kit of connected props may be considered safer than a stacking of loose, individual props, which may come apart, topple, and possibly, cause injury. Yet, the magnetic pair system allows for easy removal of one or more props from the stacked kit of props. Further, the removed prop or props may be easily returned and connected to the stacked kit of props.

The present invention is versatile in providing props and configured props. The ability to configure props into a multitude of configurations may lead to replacement of bulky, single-use props that take up room and are infrequently used. For example, the present invention may replace bulky, single use props such as headstand mounts, backbend benches, meditation seats, and hand balancing equipment.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
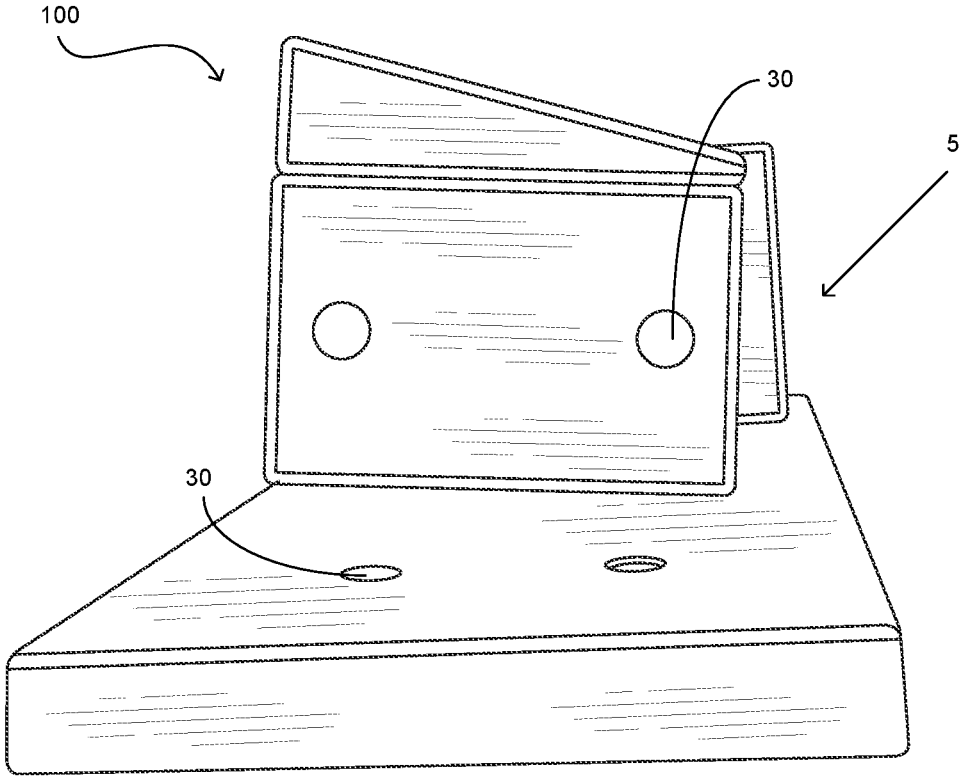
FIG. 1 is exemplary configured prop of the present invention.
Figure 2:
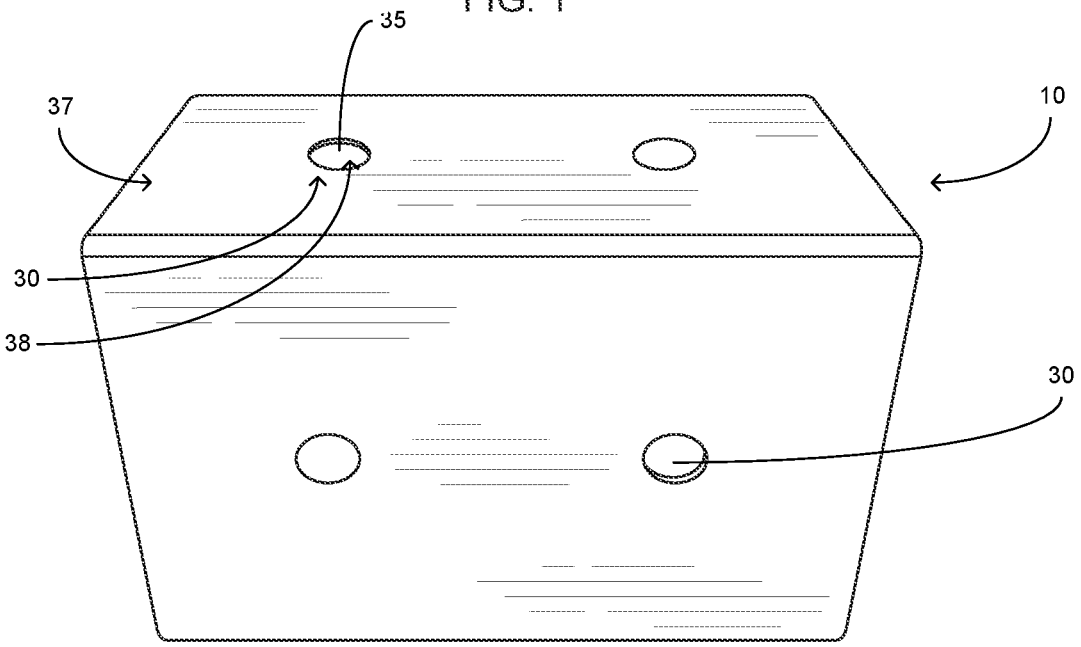
FIG. 2 is an exemplary rectangular block shaped prop of the present invention.

References now to the drawings submitted herewith, wherein various elements depicted therein are not necessarily drawn to scale and wherein through the views and figures like elements are referenced with identical reference numerals, there is illustrated a yoga block system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now to the Figures submitted herewith, illustrates yoga block system 100 including a plurality of individual props 10 that can be arranged in exemplary configurations such as the exemplary configured prop 5 illustrated herein. The props 10 illustrated herein are referred to as configured prop 5 because props 10 are connected to each other by a magnetic pair system to form the configured props 5 as is further discussed herein. Thus, the configured props 5 may be utilized, stored and moved as a single unit. Advantageously, the configured props 5 may be compactly stored, and also may provide ready access to and replacement of its individual props 10. It should be understood that any number of props 10 could be utilized to make a configured prop 5 wherein the configured prop 5 can be formed to create any shape and size. It should be further understood within the scope of the present invention that the props 5 could be provided in a plurality of shapes such as but not limited to square block, rectangular block, wedge, triangular and semi-annular.

Each of the individual props 10 may be used on its own or combined with one or more other props 10 to form a configured prop 5. Two or more individual props may be combined into a configured prop 5 using pegs 15 with one or more pegs 15 being operable to connect the individual props 10. Configured prop 5 embodiments are discussed further herein. The props 10 have an internal wood framing 20 covered in a thin layer of plywood 21. The thin layer of plywood 21 may be between 0.2 and ¼ inch thick. It should be understood within the scope of the present invention that the props 10 could have an internal frame and/or support structure that is manufactured from various alternate materials. Additionally, it is contemplated within the scope of the present invention that the props 10 could be manufactured from a solid material and that any embodiment thereof could have various materials employed to provide a covering if desired. For example, in an alternative embodiment, the composition of the props 10 may vary from prop 10 to prop 10. Generally, any material may be used for the props 10 appropriate to the respective functions of the props 10.

Reference is made below to the connection of props 10 to make configured props 5. In the exemplary configured prop 5, props 10 are connected using pegs 15 where pegs 15 are inserted into hole 26 on respective sides of the connection that is axially aligned therewith. A magnet 30 may be disposed within the holes 26 or adjacent thereto. The pegs 15 may be metallic and/or magnetic. In sum, the connection between the pegs 15 and holes 26 may be mechanical as well as magnetic in the exemplary embodiment. Other embodiments may vary.

The pegs 15 and holes 26 are spaced to facilitate connections to one or more props 10 to form the one or more configured props 5 as is explained herein. Other embodiments may vary. For example, another embodiment may include a bench prop with holes on both broad sides, or on all sides, or have fewer or more holes than ten on a side, or holes that may be spaced differently.

Each hole 26 in the prop 10 has a depth of half the length of peg 15. In this example, the depth of a hole in the prop 10 is about three quarters of an inch with about a three eighths of an inch diameter. While a cylindrical peg 15 is illustrated herein, it should be understood within the scope of the present invention that the peg 15 could be manufactured in alternate shapes and hole 26 would be mateably formed thereto.

A configured prop 5 is a prop made up of two or more props 10. The two or more props 10 may be provided in any number of shapes in order to create the desired shape for the configured prop 5 so as to facilitate execution of a desired exercise. Only a few examples of configured props 5 are described herein and it is contemplated within the scope of the present invention that a multitude of props 10 of different shapes to form various configured props 5 are possible.

Figure 3:
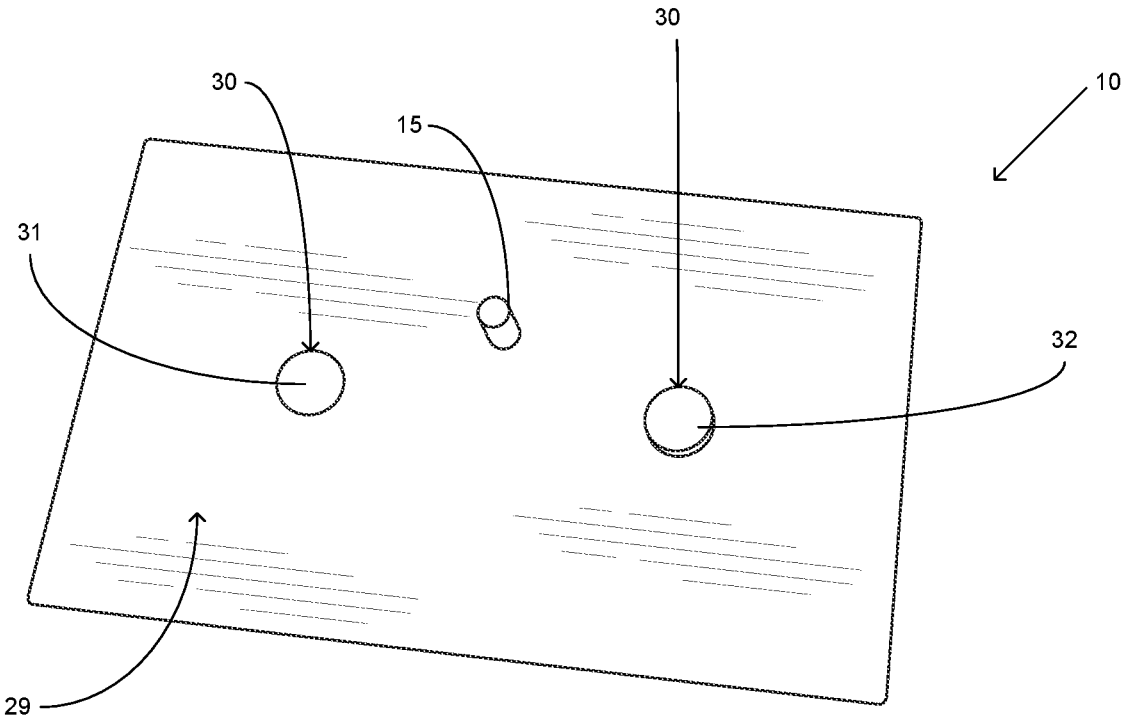
FIG. 3 is a surface of a prop of the present invention being configured with a peg and two magnets.
Figure 4:
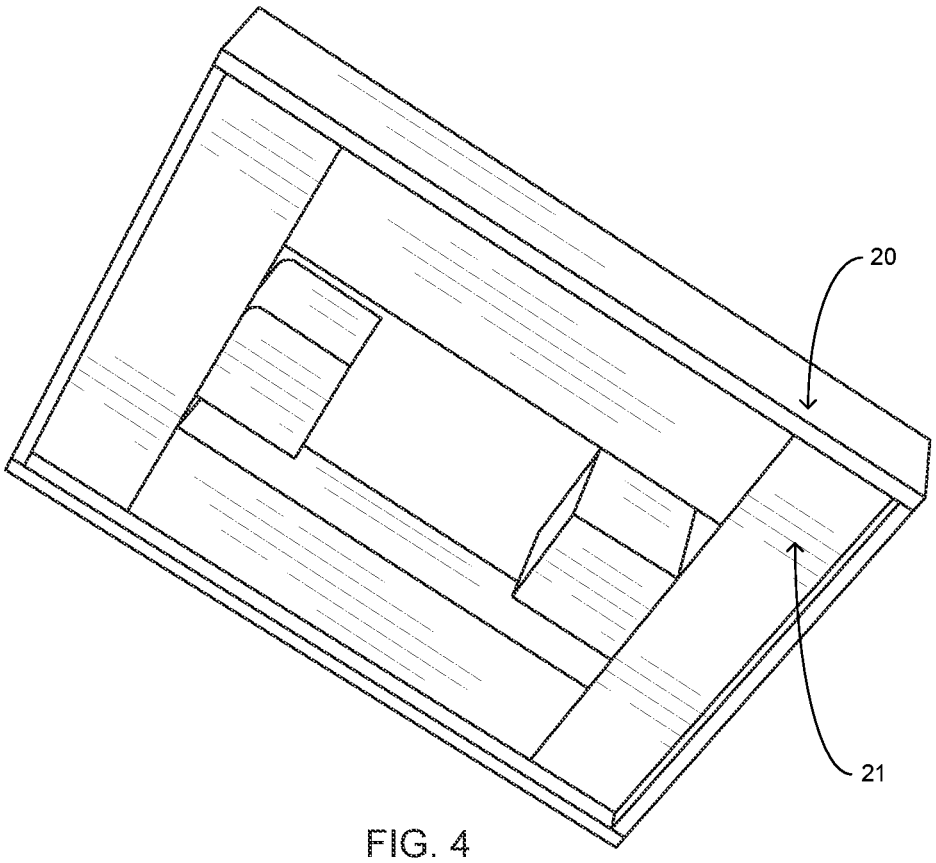
FIG. 4 is an exemplary internal frame structure of a prop of the present invention.
Figure 5:
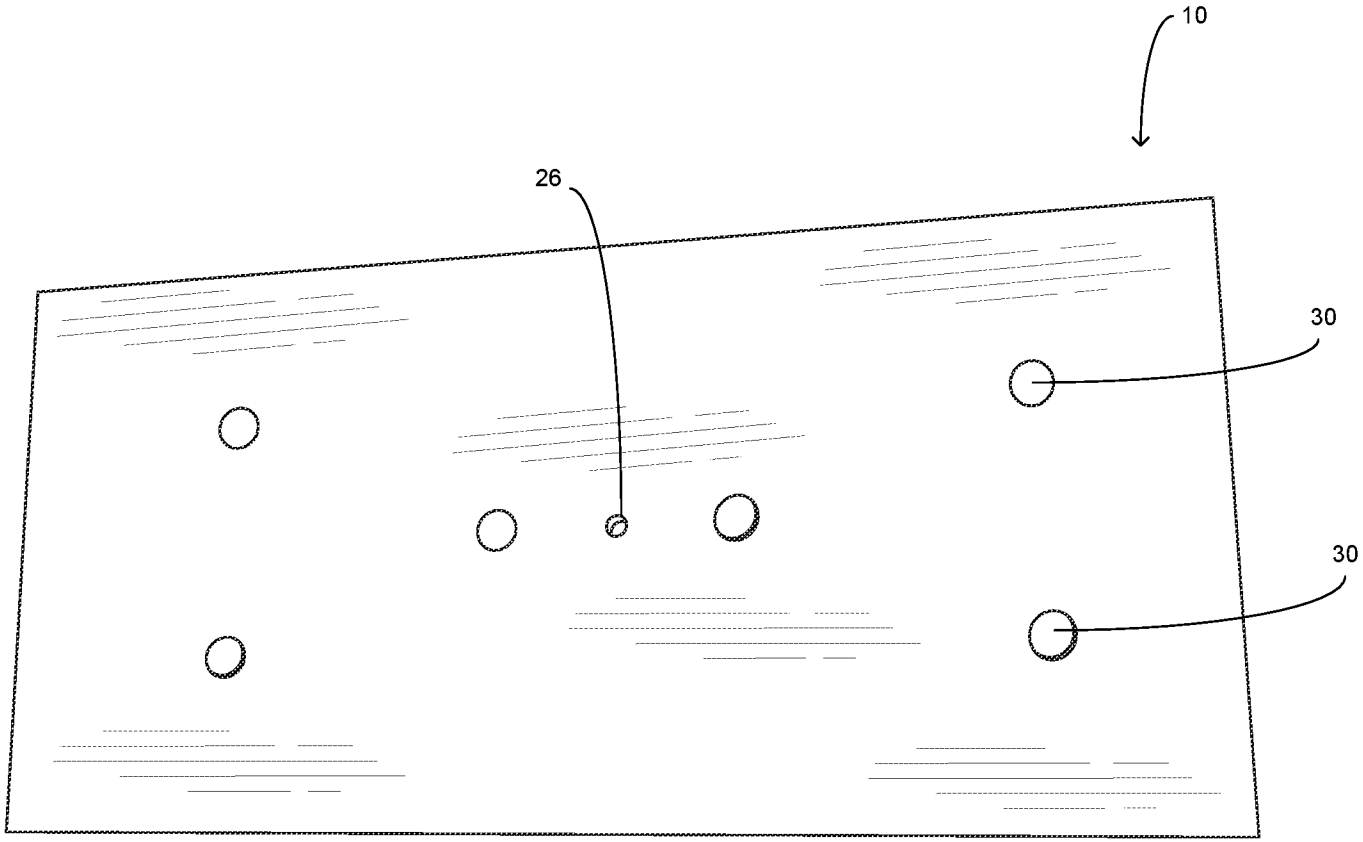
FIG. 5 is a surface of a prop of the present invention configured with a plurality of magnets and a hole.
Figure 6:
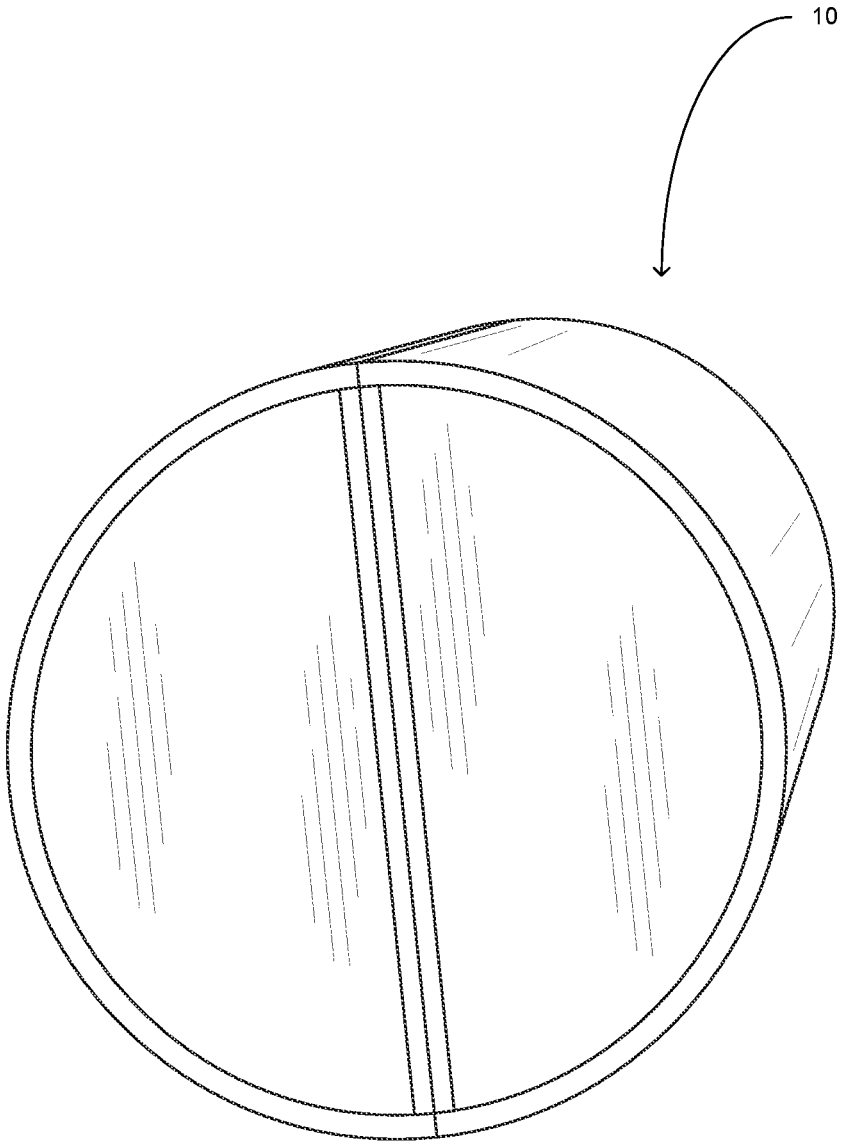
FIG. 6 is an exemplary assembled configured prop of the present invention.
Figure 7:
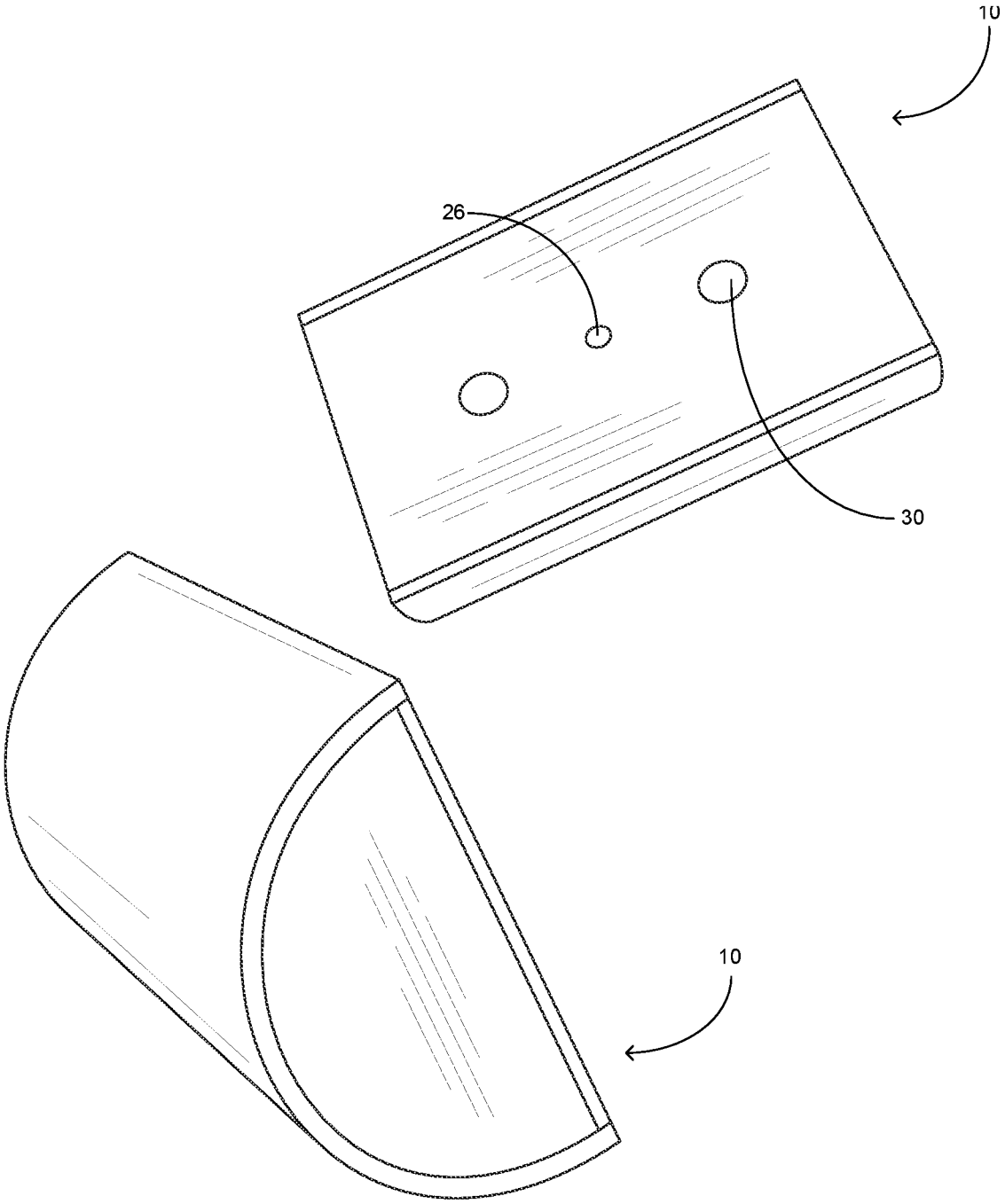
FIG. 7 is a disassembled view of the exemplary prop illustrated in FIG. 6.

FIG. 3 illustrates an exemplary surface 29 of a prop 10 having magnets 30 and peg 15 secured thereto. In this example, the upper surface of the first magnet 31 is flush with the surface 29. Second magnet 32 is positioned such that the upper surface thereof is above the surface 29 so as to have the second magnet 32 extend outward from the surface 29. The configuration of the second magnet 32 is operable to be mateably coupled with exemplary recessed magnet 35, wherein the upper surface of the recessed magnet 35 is below surface 37 of the prop 10. In this example, a portion of the second magnet 32 would extend inward into the cavity 38 above the upper surface of the recessed magnet 35. The combination of the magnetic attraction and the mechanical coupling formed by the aforementioned provides a slip-proof coupling of any two props 10 having the exemplary magnet 30 configuration as discussed.

It should be understood within the scope of the present invention that any surface of a prop 10 could be configured with alternate quantities of magnets 30 arranged in a recessed and protruding pattern so as to facilitate a magnetic and mechanical coupling with at least one additional prop 10. It is further contemplated within the scope of the present invention that a prop 10 could have more than one surface thereof having magnets 30 and/or pegs 15 thereon. It is additionally contemplated within the scope of the present invention that the magnets 30 could be provided in alternate shapes, sizes and magnetic strengths. It should be recognized by those skilled in the art that the magnets 30 of any adjoining prop 10 would be either axially aligned or aligned with corresponding patterns. Similarly, the pegs 15 and holes 26 would also be either axially aligned or aligned with corresponding patterns for any two or more props that are configured to be releasably secured to each other in order to facilitate creation of a configured prop 5. It is contemplated within the scope of the present invention that as few as one magnet 30 per surface could be employed to releasably secure two props 10 together. Alternate configurations of more than one magnet 30 per surface on a prop 10 as well as a single peg or a plurality of pegs 15 could be employed to facilitate releasable coupling of two props 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A yoga block system operable to facilitate a multitude of yoga exercises wherein the yoga block system comprises:

a first prop, said first prop having at least two surfaces, one of said at least two surfaces having a first magnet mounted therein, said first magnet being mounted in a first position, a second position or a third position, said first magnet having an upper surface, wherein one of said at least two surfaces of said first prop further includes a hole formed therein;

a second prop, said second prop having at least two surfaces, one of said at least two surfaces of said second prop having a second magnet mounted therein, said second magnet having an opposing polarity than said first magnet, said second magnet being mounted in a first position, a second position or a third position, said second magnet having an upper surface, wherein one of said at least two surfaces of said second prop has a peg secured thereto and extending outward therefrom, said peg being configured to be mateably inserted into said hole of said first prop; and wherein said first magnet and said second magnet are operable to facilitate releasable securing of said first prop and said second prop to form a configured prop and wherein in said first position of said first magnet and said second magnet, the upper surface of the first magnet and the upper surface of the second magnet are flush with an outer surface of the first prop and second prop to which the first magnet and second magnet are secured and wherein in said second position of said first magnet and said second magnet, the upper surface of the first magnet and the upper surface of the second magnet is above the outer surface of the first prop and second prop to which the first magnet and second magnet are secured.

2. The yoga block system operable to facilitate a multitude of yoga exercises as recited in claim 1, wherein in said third position of said first magnet and said second magnet, the upper surface of the first magnet and the upper surface of the second magnet is below the outer surface of the first prop and second prop to which the first magnet and second magnet are secured.

3. The yoga block system operable to facilitate a multitude of yoga exercises as recited in claim 2, wherein in said third position of said first magnet and said second magnet, a cavity is present immediately above the first magnet and second magnet.

4. The yoga block system operable to facilitate a multitude of yoga exercises as recited in claim 3, wherein upon the first magnet being in said second position and said second magnet being in said third position, a portion of said first magnet is journaled into the cavity present above the second magnet.

5. The yoga block system operable to facilitate a multitude of yoga exercises as recited in claim 4, wherein said configured prop is configured to be provided in a plurality of shapes based on positioning of the first prop and the second prop.

6. A yoga block system operable to facilitate a multitude of yoga exercises wherein the yoga block system comprises:

a plurality of props, each of said plurality of props having a plurality of surfaces, wherein a first prop of said plurality of props includes at least two magnets mounted to a surface of said first prop, wherein said at least two magnets are mounted in either a first position, a second position or a third position, said plurality of props further including a second prop, said second prop having at least two magnets mounted to a surface thereof, said at least two magnets of said second prop being mounted in either a first position, a second position or a third position, wherein in said first position said at least two magnets are flush with an upper surface of the surface of the first prop and second prop to which the at least two magnets are mounted and wherein in said second position said at least two magnets are extended above the upper surface of the surface of the first prop and second prop to which the at least two magnets are mounted;

wherein said plurality of props are configured to be releasably secured to form a configured prop, wherein said configured prop includes at least two props of said plurality of props, wherein said configured prop is provided in alternate shapes and sizes, wherein at least one of said plurality of props includes a peg, said peg being mounted to a surface of said at least one plurality of props, said peg extending outward from said surface of said at least one of said plurality of props and wherein at least one of said plurality of props includes a hole, said hole being formed in a surface of said at least one plurality of props, said hole configured to have said peg mateably inserted thereinto; and wherein said plurality of props are provided in shapes selected from a group consisting of: square block, rectangular block, wedge, triangular or semi-annular.

7. The yoga block system operable to facilitate a multitude of yoga exercises as recited in claim 6, wherein in said third position said at least two magnets are below the upper surface of the surface of the first prop and second prop to which the at least two magnets are mounted.

8. The yoga block system operable to facilitate a multitude of yoga exercises as recited in claim 7, and further including a cavity, said cavity being present above said at least two magnets upon said at least two magnets being in said third position.

* * * * *